US008302615B2

(12) United States Patent
Thiebaut

(10) Patent No.: US 8,302,615 B2
(45) Date of Patent: Nov. 6, 2012

(54) APPLICATOR FOR A COSMETIC PRODUCT

(75) Inventor: Laure Thiebaut, Clichy (FR)

(73) Assignee: L'Oreal, Paris (FR)

( * ) Notice: Subject to any disclaimer, the term of this patent is extended or adjusted under 35 U.S.C. 154(b) by 157 days.

(21) Appl. No.: 12/480,341

(22) Filed: Jun. 8, 2009

(65) Prior Publication Data

US 2009/0301512 A1 Dec. 10, 2009

Related U.S. Application Data

(60) Provisional application No. 61/083,441, filed on Jul. 24, 2008.

(30) Foreign Application Priority Data

Jun. 6, 2008 (FR) ..... 08 03173

(51) Int. Cl.
*A45D 40/26* (2006.01)

(52) U.S. Cl. ..... 132/320; 132/112; 401/137

(58) Field of Classification Search ..... 132/320, 132/290, 289, 112; 401/137, 123, 125; 15/105, 15/176.1–176.6, 246; 222/148, 465.1; 206/77.1, 206/277, 524.1, 527; 220/759, 694, 697, 220/699; 248/311.2; D9/719
See application file for complete search history.

(56) References Cited

U.S. PATENT DOCUMENTS 262,677 A * 8/1882 Keane ..... 15/105
2,741,786 A * 4/1956 Bressler ..... 401/123
2,851,713 A * 9/1958 Tupper ..... 15/105
2,944,273 A * 7/1960 Harris ..... 15/105
3,008,164 A * 11/1961 Herman et al. ..... 15/160
3,011,499 A * 12/1961 Tajan ..... 401/139
3,031,711 A * 5/1962 Herman et al. ..... 401/27
3,754,831 A * 8/1973 Hutter ..... 401/139
3,961,729 A * 6/1976 Grimm ..... 222/192
4,733,984 A * 3/1988 Katsuda et al. ..... 401/190
4,969,854 A * 11/1990 Katsuda et al. ..... 401/190
5,125,757 A * 6/1992 Morrison et al. ..... 401/21
5,131,384 A * 7/1992 Obagi ..... 601/131
5,224,234 A * 7/1993 Arsenault et al. ..... 15/167.1
5,299,876 A * 4/1994 Singarella ..... 401/139
D387,563 S * 12/1997 Koptis ..... D4/114
5,997,411 A * 12/1999 Holub ..... 473/282
6,151,746 A * 11/2000 Lewis, Jr. ..... 15/187
D439,835 S * 4/2001 Boldt ..... D9/719
6,302,608 B1 * 10/2001 Holmes et al. ..... 401/125
6,487,748 B1 * 12/2002 Dardar et al. ..... 15/167.1
7,168,873 B2 * 1/2007 Shawan et al. ..... 401/6
7,726,499 B2 * 6/2010 Williamson et al. ..... 215/396

(Continued)

FOREIGN PATENT DOCUMENTS

EP 1 621 103 2/2006

(Continued)

*Primary Examiner* — Todd Manahan
*Assistant Examiner* — Tatiana Nobrega
(74) *Attorney, Agent, or Firm* — Oblon, Spivak, McClelland, Maier & Neustadt, L.L.P.

(57) ABSTRACT

Applicator for a cosmetic product on the skin, intended to be mounted on the body of a container containing the product to be applied, comprising a support strip, means of application borne by the support strip, and fastening means by clipping of said support strip along the body of the container, in such a way that this container forms a handle for using the applicator.

18 Claims, 3 Drawing Sheets

U.S. PATENT DOCUMENTS

| | | | | |
|---|---|---|---|---|
| 7,730,570 | B1 * | 6/2010 | Billups | 15/144.4 |
| 2002/0049399 | A1 * | 4/2002 | Stampf | 601/114 |
| 2002/0184724 | A1 * | 12/2002 | Saar | 15/167.1 |
| 2003/0225352 | A1 | 12/2003 | Eckers et al. | |
| 2004/0243036 | A1 * | 12/2004 | Ki et al. | 601/135 |
| 2005/0061829 | A1 | 3/2005 | Tsaur | |
| 2005/0251071 | A1 * | 11/2005 | Zhadanov et al. | 601/136 |
| 2006/0037886 | A1 * | 2/2006 | Thiebaut | 206/581 |
| 2006/0231715 | A1 * | 10/2006 | Yang | 248/311.2 |
| 2006/0276730 | A1 * | 12/2006 | Thiebaut et al. | 601/112 |
| 2007/0000566 | A1 | 1/2007 | Gueret | |
| 2007/0017833 | A1 * | 1/2007 | Lukan | 206/228 |
| 2007/0125113 | A1 | 6/2007 | Habatjou | |
| 2009/0184147 | A1 * | 7/2009 | Wen | 224/461 |

FOREIGN PATENT DOCUMENTS

| | | | |
|---|---|---|---|
| EP | 1 726 233 | | 11/2006 |
| EP | 1 795 086 | | 6/2007 |
| FR | 2 838 619 | | 10/2003 |
| WO | WO 9410062 | A1 * | 5/1994 |
| WO | WO 02/26576 | | 4/2002 |

* cited by examiner

APPLICATOR FOR A COSMETIC PRODUCT

CROSS REFERENCE TO RELATED APPLICATIONS

This document claims priority to French Application Number 08/03173, filed Jun. 6, 2008, and U.S. Provisional Application No. 61/083,441, filed Jul. 24, 2008, the entire contents of each of which are hereby incorporated by reference.

FIELD OF THE INVENTION

This invention relates to an applicator for a cosmetic product as well as to a container-applicator unit comprising an applicator associated with a container containing a cosmetic product.

BACKGROUND OF THE INVENTION

In this application, cosmetic product means a product such as defined in the 93/35/EEC Directives of the Council of 14 Jun. 1993.

Units of this type are known wherein the applicator fixed on a portion of the container is intended to be placed in contact and displaced on the skin of a person in order to apply a cosmetic product deposited beforehand on the skin.

Application EP-A2-1 726 233 discloses a container wherein massaging projections are mounted on the head of the container, the body of this container serving as a handle for using the projections for their displacement on the skin of a person. However, grasping this container is not ergonomic. In addition, the surface allocated for the massaging projections is limited by the size of the head of the container which is relatively small.

Application US-A-2003/0225352 discloses a unit of the aforementioned type of which the applicator is formed by rotating massaging beads that protrude on the body of the container. This solution makes it possible to increase the useful surface of the applicator but reduces by as much the surface of the container which is used for the presentation of information, such as instructions, intended for the user. In addition, the applicator is not dissociable from the container and therefore cannot easily be cleaned.

OBJECTS AND SUMMARY OF THE INVENTION

The invention makes it possible to simply, effectively and economically overcome the aforementioned disadvantages of prior art.

It proposes for this purpose an applicator for a cosmetic product, in particular on the skin, intended to be mounted on the body of a container containing the product to be applied, characterized in that it comprises a support strip, means of application borne by the support strip, and removable means of attaching through clipping of said support strip along a longitudinal axis of the body of the container, in such a way that this container forms a handle for using the applicator.

In this application, applicator means any device comprising "means of application" able to spread a composition, in particular a cosmetic composition, on keratin materials, such as the skin or keratin fibers (lashes, hair). An applicator according to this invention is more particularly configured to apply a product on the skin. The "means of application" according to the invention can cumulatively be configured to allow for the massaging and/or the exfoliating of the skin.

The applicator can be easily fixed and detached from the body of the container, which makes it possible to facilitate its cleaning after use and to retain the totality of the exterior surface of the body of the container for the presentation of information intended for the user. The applicator extends along the body of the container and does not hinder or hinders very little the reading of this information. For its use, the applicator is clipped on the body of the container, the body of the container is grasped by the hand of a person, who places the applicator in contact with a portion of his body, and who then displaces the container in a plane substantially parallel to the longitudinal axis of the container. The container is for example an aerosol, a bottle, a tube, a stick, etc. The applicator is for example made from rigid or semi-rigid plastic material.

According to a characteristic of the invention, the means of attaching include at least one flexible fastening tab on the body of the container. The location and the configuration of these means of attaching are determined in such a way as to leave visible a major portion of the information mentioned on the body of the container when the applicator is mounted on the container.

The fastening tab(s) can extend in planes substantially perpendicular to the support strip. They can extend from the same side of the support strip and be spaced one from the other along the body of the container. Alternatively, the fastening tabs are on two opposite sides of the support strip.

The applicator comprises for example four flexible tabs for fastening on the body of the container, these tabs being formed at the ends of the support strip on the two sides of the latter.

The or each flexible tab has more preferably an angular extent greater than 180°.

The means of application, of massaging or of exfoliating borne by the support strip can include rollers, beads, fixed protruding elements, a brush, an alveolar element, an abrasive element, a comb, alone or in combination.

This invention also relates to a container-applicator unit, comprising an applicator of the type described hereinabove mounted by clipping on the body of a container containing a cosmetic product, this container serving as a handle for the use of the applicator.

BRIEF DESCRIPTION OF THE DRAWINGS

The invention shall be better understood and other details, characteristics and advantages of this invention will appear more clearly when reading the following description, given by way of non-limiting example and in reference to the annexed drawings wherein.

MORE DETAILED DESCRIPTION

Figure 1:
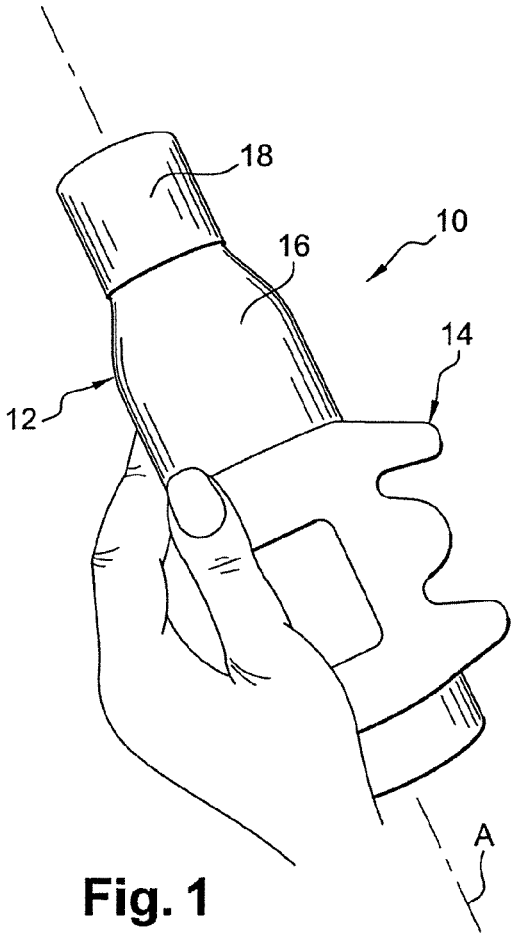
FIG. 1 is a schematic perspective view of a container-applicator unit according to the invention, held by a person.

Reference is first made to FIGS. 1 to 4 which show a first embodiment of a container-applicator unit 10 according to the invention, this unit 10 comprising a container 12 containing a cosmetic product and an applicator 14 which is fixed by clipping along a longitudinal axis of the body 16 of the container in such a way that the container forms a handling for using the applicator. This applicator 14 can be used before the depositing of the cosmetic product on the skin of a person in order to massage or exfoliate this skin, or after the depositing of the cosmetic product in order to facilitate its application on the skin.

The body 16 of the container here has an elongated cylindrical shape of longitudinal axis A, and bears at one end a distribution head of the cosmetic product, wherein is mounted a closing and protective cap 18. For example, the container 12 is of the aerosol type and comprises an anti-cellulite serum, the distribution head comprising a spraying nozzle of the serum on the skin of a person.

Figure 4:
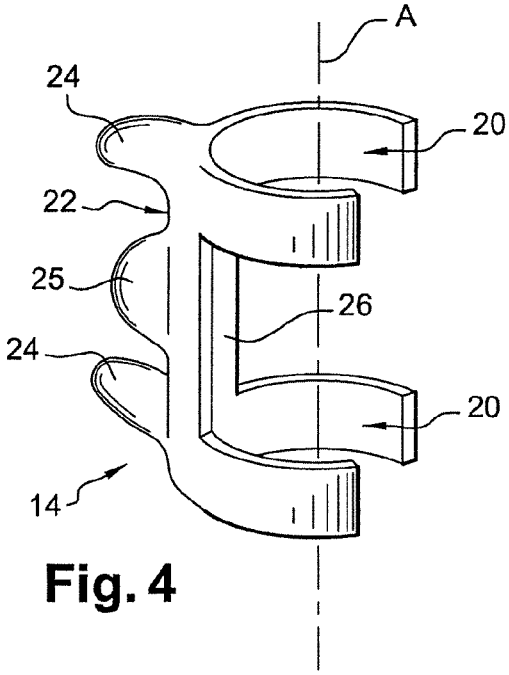
FIG. 4 is a schematic perspective view of the applicator of the unit in FIG. 1.

The applicator 14, better seen in FIG. 4, comprises a strip 22 bearing massaging fingers 24, 25, this strip being linked to flexible fastening tabs 20 by clipping on the body 16 of the container 12. In the clipping position shown in FIG. 1, the strip 22 extends in parallel to the axis A of the container.

The tabs 20 here number four, the strip 22 being linked to each one of its longitudinal ends to two tabs 22 that extend on two opposite sides of the strip.

The tabs 20 located on one side of the strip 22 are substantially identical to one another. They are in addition symmetrical to those located on the other side of the strip 22 in relation to a central plane passing through the axis A and substantially in the middle of the strip. In the example shown, these tabs 20 extend through planes substantially perpendicular to the strip 22.

The tabs 20 have a rounded shape of an arc of a circle which is complementary to that of the body 16 of the container. They are elastically deformable in such a way that the free ends of the tabs 20 can be separated towards the exterior, i.e. on the side opposite the container 12. When the applicator 14 is fixed on the body 16 of the container 12, the tabs 20 hug the shape of the body of the container, their internal cylindrical surface being against the external cylindrical surface of the body of the container. This cylindrical surface has, according to a transversal section plane, a round, oval section, or comprising at least one rounded portion such as a semi-circle. Each tab 20 extends around the longitudinal axis A of the container over an angular extent greater than 90° in such a way that the tabs located on either side of each longitudinal end of the strip 22 extend together over an angular extent greater than 180°.

The strip 22 is rigid or semi-rigid. It comprises an interior surface 26 which is intended to come into contact with the body 16 of the container 12 when the applicator 12 is fixed on the container. This surface 26 defines a portion of a cylinder according to the same longitudinal axis A as the body 16 of the container. The inner radius of curvature of this surface 26 is chosen substantially equal to the radius of curvature of the external surface defined by the body, in the same section plane.

The massaging fingers 24, 25 are located on the exterior surface of the strip and extend in transversal direction of the opposite side of the container 12. The fingers 24, 25 number three in the example shown: two fingers 24 respectively upper and lower, and an intermediary finger 25. The fingers 24, 25 are spaced one from the other and aligned one behind the other along the axis A.

The finger 25 is substantially of the shape of a hemisphere of which the radius of curvature R1 is between 15 and 25 mm, and is for example of approximately 20 mm. The fingers 24 have a substantially cylindrical shape, with their free ends forming a hemisphere with a radius of curvature R2 between 5 and 15 mm, and for example of approximately 10 mm. The fingers 24 converge towards one another on the side opposite to the container. They are for example inclined at an angle $\alpha$ between 10 and 15° in relation to a plane perpendicular to the axis A. Their free ends are spaced one from the other by a distance of 50 to 60 mm, and for example of approximately 53 mm. They have a length between approximately 2 and 3 cm. They are longer by 5 to 10 mm for example than the finger 25, in relation to the support strip 22.

In the example shown, the applicator 14 is formed of a single part of rigid or semi-rigid plastic material.

Figure 2:
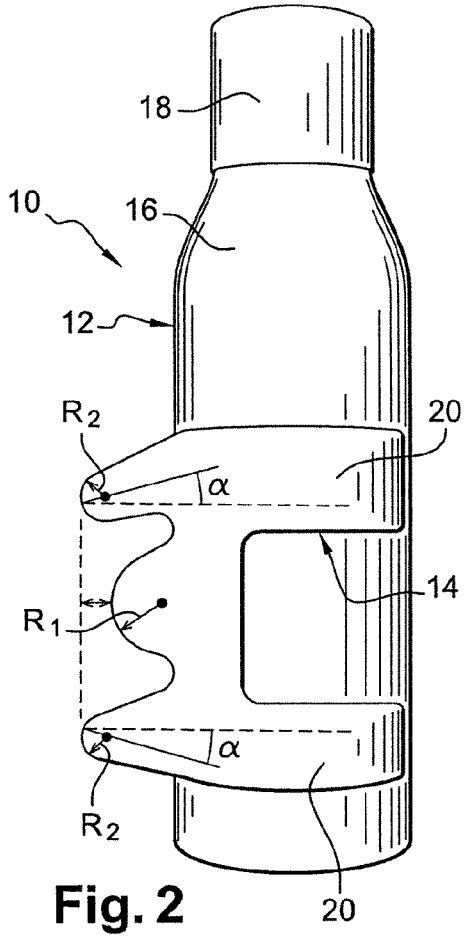
FIG. 2 is another partial schematic view in perspective of the unit in FIG. 1.
Figure 3:
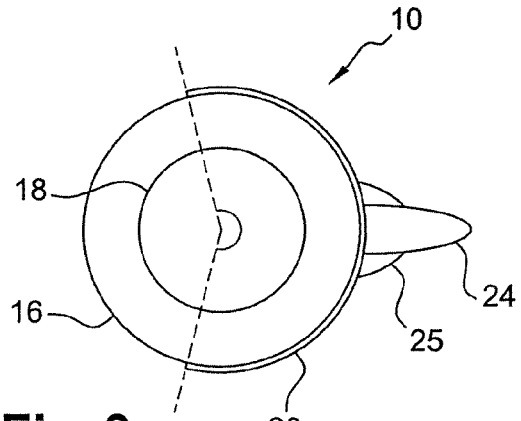
FIG. 3 is a schematic top view of the unit in FIG. 1.

The container-applicator unit 10 according to the invention is used in the following manner: the applicator 14 is brought next to the body 16 of the container 12 in such a way that the strip 22 is parallel to the axis A of the container and that the free ends of the tabs 20 are located on the side of the body of the container. The applicator 14 is then displaced towards the container 16 in a direction substantially perpendicular to the axis A until the applicator 14 clips onto the body of the container, as shown in FIGS. 1 and 2. A person then grasps with one hand the body of the container as shown in FIG. 1, places the massaging fingers 24, 25 against a portion of his body and begins massaging this portion of the body by displacing the receptacle along the axis A or in a direction perpendicular to this axis. The product contained in the container can be deposited on this portion of the body before or after its massaging. The difference in the length of the fingers 24, 25 makes it possible, when the skin is pressed upon, to create either a fold of skin (between the fingers 24) if this skin is very firm or if the force of application is low, two folds of skin (one fold between each pair of fingers 24 and 25) if the skin is softer or if the force of application is considerable.

In clipping position, the applicator 14 is more preferably displaceable by sliding on the body of the container, along and/or around the axis A. This makes it possible to have access to all of the information present on the body of the container without having to detach the applicator from the container. During the use of the container-applicator unit, the applicator is immobilized on the body of the container by the hand that is holding the container and which is tightly maintaining the tabs 20 of the applicator on the body 16 of the container.

Figure 5:
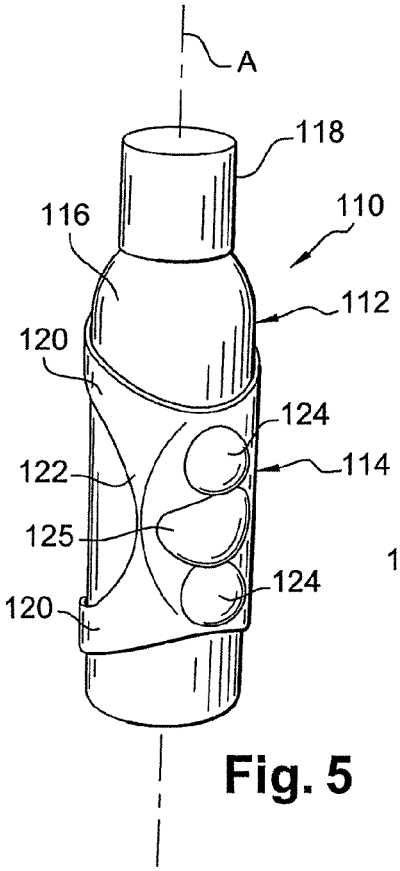
FIG. 5 is a schematic perspective view of an alternative embodiment of the container-applicator unit according to the invention.
Figure 6:
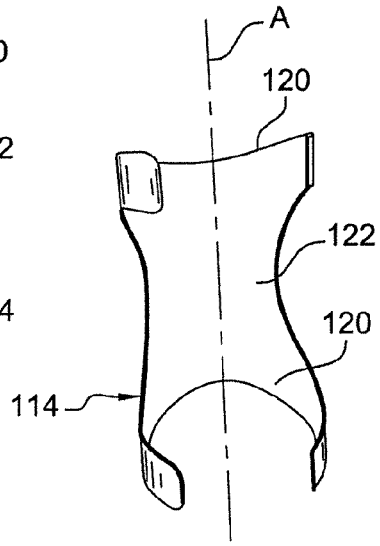
FIG. 6 is a schematic perspective view of the applicator of the unit in FIG. 5.
Figure 7:
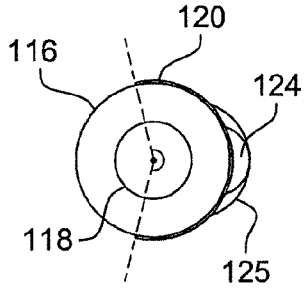
FIG. 7 is a schematic top view of the unit in FIG. 5.

In the alternative embodiment shown in FIGS. 5 to 7, the applicator 114 also comprises a strip 122 and four flexible fastening tabs 120. The strip 122 differs from that of the unit in FIGS. 1 to 4 in particular in that its fingers 124 and 125 substantially have the same length in transversal direction in relation to the axis A.

The tabs 120 differ from tabs 20 mentioned hereinabove in that each tab 120 extends in an inclined manner in relation to the axis A of the container 112, the tabs 120 located at the upper end of the strip 122 extending from this strip upwards and the tabs 120 located at the lower end of the strip 122 extending from this strip downwards.

Figure 8:
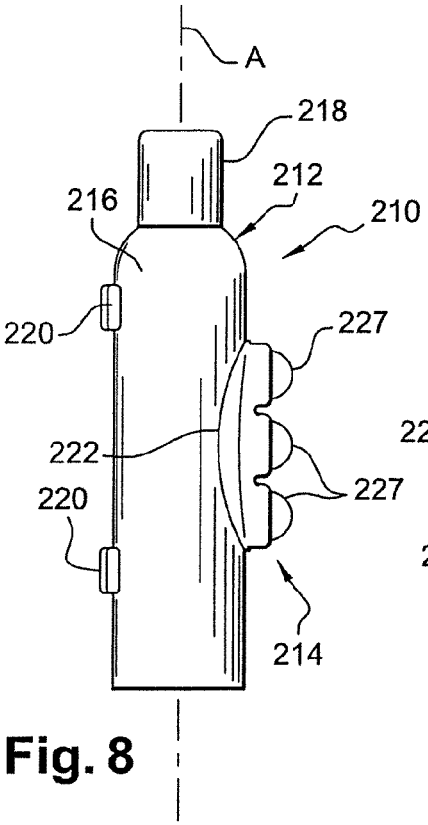
FIG. 8 is a schematic perspective view of another alternative of the container-applicator unit according to the invention.
Figure 9:
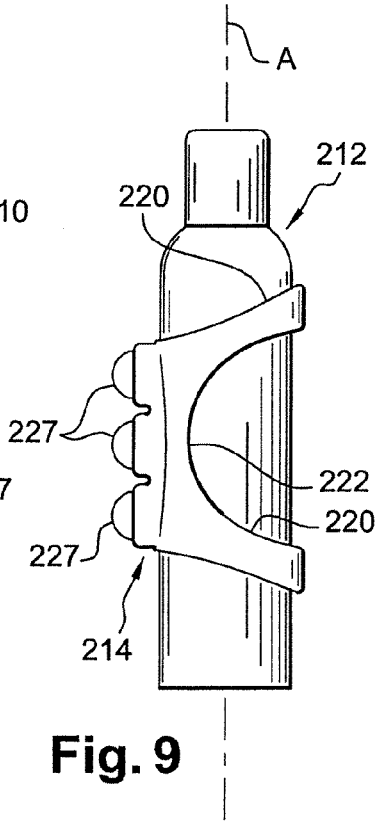
FIG. 9 is another schematic view in perspective of the unit in FIG. 8.
Figure 10:
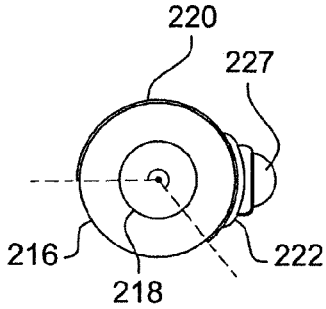
FIG. 10 is a schematic top view of the unit in FIG. 8, and FIGS. 11 and 12 are schematic views in perspective of another alternative embodiment of an applicator according to the invention.

In the alternative shown in FIGS. 8 to 10, the applicator 214 comprises only two flexible fastening tabs 220, and a strip 222 whereon beads 227 are mounted freely rotating.

The tabs 220 are located on the same side of the strip 222. They extend in a substantially helicoidal manner around the axis A. The strip 222 is linked at its upper end to a first tab 220 that extends upwards from the strip, and at its lower end to a second tab 220 which extends downwards from the strip. Each tab 220 has an angular extent around the axis A which is greater than 180°.

The beads 227 here number three and are substantially identical. Each one of these beads is encased in a corresponding housing of the strip 222 and is free to move in rotation in its housing in order to be able to roll on the skin of a person when the container-applicator unit 210 is applied and displaced on this skin.

In another alternative which is not shown, the applicator comprises a single flexible fastening tab on the body of the container. In yet another alternative, the applicator comprises means of application, of massaging or of exfoliating of another type, such as for example at least one roller, a brush, an alveolar element, an abrasive element, a comb, etc. For example, the means of application can comprise at least one roller made of a foam material for applying and uniformly distributing on the body of a person the cosmetic product which can be a sunscreen. The means of application can also comprise a metallic surface for applying an aftersun emulsion on the body of a person so as to obtain a fresh and refreshing effect when the metallic surface is in contact with the skin of the person. This metallic surface can be formed by a small metallic plate carried by the applicator, this plate being preferably domed or camber.

The means of application can further be fastened in a removable manner on the strip of the applicator in such a way as to be able to replace them, for example in the event of wear and tear.

Figure 11:
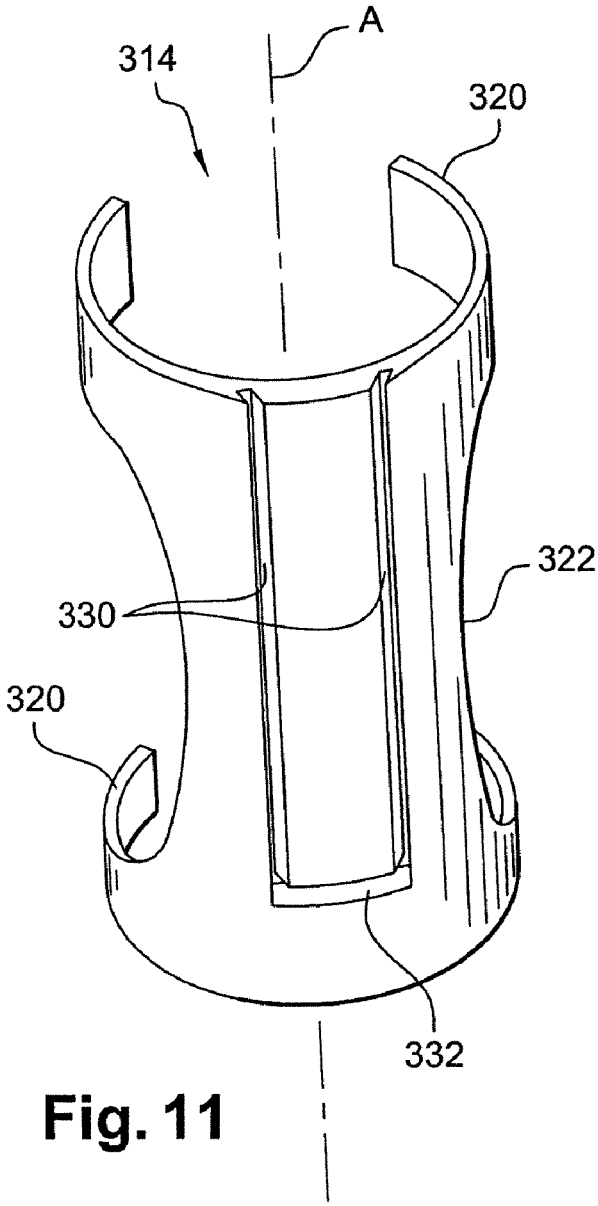
Figure 12:
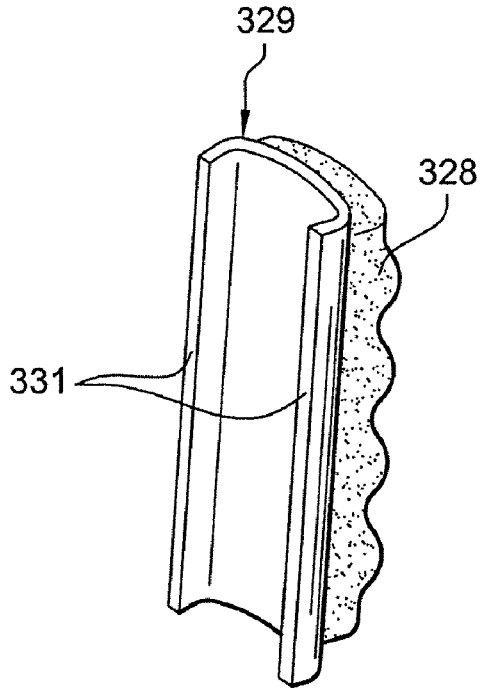

FIGS. 11 and 12 show an applicator 314 of which the means of application are fixed in a removable manner on the strip 322 by a sliding rail system.

The tabs 320 of the applicator are similar to tabs 120 in FIGS. 5 to 7.

In the example shown, the means of application include a block 328 of abrasive foam (of the type of that described in EP 1 621 103) which is fixed for example by gluing on a fastening member 329 to the strip 322. The member 329 here is formed of a substantially rectangular plate, the block 328 being fixed on one of the faces of this plate that comprises two lateral parallel edges 331 extending on the opposite side of the block 328.

The strip 322 comprises two parallel grooves 30 wherein are intended to be engaged the lateral edges 331 of the member 329. The grooves 330 extend along the longitudinal axis A, over a major portion of the longitudinal dimension of the strip 322. They exit at their upper ends on the upper edge of the strip and are linked to one another at their opposite ends by a transversal groove 332.

The member 329 is fixed on the strip 322 by presenting it above the strip and by axially aligning its lateral edges 331 with the openings of the grooves 330, then by displacing the member towards the strip in a direction parallel to the axis A, until the lateral edges penetrate and slide in the grooves 330 and at their lower ends abut against the lower lateral wall of the transversal groove 332.

The invention claimed is:

1. An applicator for a cosmetic product configured to be used on the skin or on keratin fibers and intended to be mounted on a body of a container containing the cosmetic product to be applied to the skin or keratin fibers, consisting essentially of:

a support strip, an application portion which is configured to apply the cosmetic product, which is borne by the support strip, and which is configured for use on the skin or on the keratin fibers, said application portion including at least one of a plurality of rollers, a plurality of beads, a bristle brush, an alveolar element, an abrasive element, a comb, or a plurality of massaging fingers, and a fastening portion that is configured to removably fasten, through clipping, said support strip along a longitudinal axis of the body of the container, in such a way that the container forms a handle during use of the applicator, wherein the fastening portion includes only two flexible fastening tabs configured to fasten to the body of the container, said two flexible tabs being located on a single and same side of the support strip and including one upper flexible tab having one end connected to an upper end of the fastening portion and one lower flexible tab having one end connected to a lower end of the fastening portion, said one upper flexible tab and one lower flexible tab being inclined relative to the longitudinal axis of the body of the container and extending in opposite direction, respectively upward and downward.

2. The applicator set forth in claim 1, wherein said at least two flexible fastening tabs extend from a same side of the support strip and are spaced one from the other along the body of the container.

3. The applicator set forth in claim 1, wherein said at least two flexible fastening tabs are on two opposite sides of the support strip.

4. The applicator set forth in claim 3, wherein said at least two flexible fastening tabs include four flexible tabs which are formed at upper and lower ends of the support strip on two opposite sides of the support strip.

5. The applicator set forth in claim 1, wherein each one of the at least two flexible tabs has an angular extent greater than 180°.

6. The applicator set forth in claim 1, wherein the applicator is made from rigid or semi-rigid plastic material.

7. The applicator set forth in claim 1, wherein a location and a configuration of the fastening portion is determined in such a way as to leave visible a major portion of an indication mentioned on the body of the container when the applicator is mounted on the container.

8. A container-applicator unit, comprising an applicator set forth in claim 1 mounted by clipping on the body of a container containing a cosmetic product, the container serving as a handle for the use of the applicator.

9. The applicator set forth in claim 1, wherein the application portion includes the plurality of massaging fingers, and the plurality of massaging fingers each include a free end that forms a hemisphere.

10. The applicator set forth in claim 9, wherein said massaging fingers are spaced one from the other and aligned one behind the other along the longitudinal axis of the body of the container.

11. The applicator set forth in claim 9, wherein said hemisphere has a radius of between 5 mm and 25 mm.

12. The applicator set forth in claim 9, wherein at least one of the fingers is inclined at an angle $\alpha$ of between 10° and 15° in relation to a plane perpendicular to the longitudinal axis of the body of the container.

13. The applicator set forth in claim 1, wherein the application portion includes the plurality of beads, and the plurality of beads are configured to rotate freely in the applicator.

14. The applicator set forth in claim 1, wherein the application portion includes a metallic surface formed by a metallic plate carried by the applicator.

15. The applicator set forth in claim 1, wherein the application portion is removably fastened to the support strip.

16. The applicator set forth in claim 15, wherein the application portion is fastened to the support strip by a sliding rail system.

17. The applicator set forth in claim 1, wherein the application portion includes the abrasive element, and the abrasive element is an abrasive foam block.

18. The applicator set forth in claim 1, wherein the application portion includes one, two, or three protruding elements, and each of the protruding elements include a finger, a bead, or a block shape.

* * * * *